US012442257B2

(12) United States Patent
Karakaya et al.

(10) Patent No.: US 12,442,257 B2
(45) Date of Patent: Oct. 14, 2025

(54) COMPLETING AND WORKING OVER A WELLBORE

(71) Applicant: Saudi Arabian Oil Company, Dhahran (SA)

(72) Inventors: Mustafa Karakaya, Dhahran (SA); Sohrat Baki, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 213 days.

(21) Appl. No.: 18/322,371

(22) Filed: May 23, 2023

(65) Prior Publication Data

US 2024/0392630 A1 Nov. 28, 2024

(51) Int. Cl.

| | |
|---|---|
| ***E21B 17/02*** | (2006.01) |
| ***E21B 17/043*** | (2006.01) |
| ***E21B 17/10*** | (2006.01) |
| ***E21B 47/00*** | (2012.01) |

(52) U.S. Cl.

CPC ..... *E21B 17/021* (2013.01); *E21B 17/043* (2013.01); *E21B 17/1085* (2013.01); *E21B 47/006* (2020.05)

(58) Field of Classification Search

CPC .. E21B 17/021; E21B 17/043; E21B 17/1085; E21B 47/006

See application file for complete search history.

(56) References Cited

U.S. PATENT DOCUMENTS

| | | | | |
|---|---|---|---|---|
| 3,710,864 | A | 1/1973 | Mitchell | |
| 4,301,241 | A | 11/1981 | Saito | |
| 4,434,226 | A | 2/1984 | Wilgus et al. | |
| 4,601,343 | A | 7/1986 | Lindsey, Jr. et al. | |
| 4,601,498 | A * | 7/1986 | Haugen | F16L 15/008 285/907 |
| 4,660,863 | A | 4/1987 | Bailey et al. | |
| 4,739,475 | A | 4/1988 | Mensch | |
| 4,754,810 | A | 7/1988 | Bennett et al. | |
| 4,755,456 | A | 7/1988 | Sugimoto | |
| 4,792,523 | A | 12/1988 | Wong et al. | |
| 4,830,109 | A | 5/1989 | Wedel | |
| 4,914,014 | A | 4/1990 | Daubendiek et al. | |
| 5,279,952 | A | 1/1994 | Wu | |
| 5,318,888 | A | 6/1994 | Weberg et al. | |
| 5,595,864 | A | 1/1997 | Van den Zegel et al. | |
| 5,616,455 | A | 4/1997 | Murphy | |
| 5,702,879 | A | 12/1997 | Barcock | |
| 5,714,323 | A | 2/1998 | Ohshima et al. | |
| 5,743,335 | A | 4/1998 | Bussear | |
| 5,785,120 | A | 7/1998 | Smalley et al. | |
| 5,827,177 | A | 10/1998 | Oneda et al. | |
| 5,829,524 | A | 11/1998 | Flanders et al. | |
| 5,856,733 | A | 1/1999 | Matsumoto et al. | |

(Continued)

*Primary Examiner* — Kristyn A Hall

(74) *Attorney, Agent, or Firm* — Fish & Richardson P.C.

(57) ABSTRACT

An assembly and method for completing a wellbore. The assembly includes a polished bore receptacle, a torque lock ring, and a left-hand threaded coupling. The torque lock ring is positioned inside the polished bore receptacle. The torque lock ring couples the polished bore receptacle to an upper completion assembly. The left-hand threaded coupling is positioned inside the polished bore receptacle. The left-hand threaded coupling receives a left-hand threaded surface of the upper completion assembly.

20 Claims, 5 Drawing Sheets

(56) References Cited

U.S. PATENT DOCUMENTS 5,954,132 A 9/1999 Harris et al.
5,957,195 A 9/1999 Bailey et al.
6,020,708 A 2/2000 Matsumoto et al.
6,039,120 A 3/2000 Wilkins et al.
6,093,554 A 7/2000 Haute et al.
6,105,673 A 8/2000 Harris et al.
6,142,230 A 11/2000 Smalley et al.
6,197,542 B1 3/2001 Haute et al.
6,302,208 B1 10/2001 Walker et al.
6,523,110 B1 2/2003 Bright et al.
6,558,892 B2 5/2003 Elst et al.
6,587,187 B2 7/2003 Watanabe et al.
6,621,946 B2 9/2003 Yu et al.
6,668,930 B2 12/2003 Hoffman
6,775,894 B2 8/2004 Hardin
6,825,637 B2 11/2004 Kinpara et al.
6,840,325 B2 1/2005 Stephenson
6,878,549 B1 4/2005 Vogels et al.
6,915,852 B2 7/2005 Baugh et al.
7,003,619 B1 2/2006 Moore et al.
7,039,786 B2 5/2006 Suzuki et al.
7,048,125 B2 5/2006 Mize et al.
7,164,999 B2 1/2007 Tabatabaei et al.
7,272,503 B2 9/2007 Strack et al.
7,303,595 B1 12/2007 Janitz
7,308,934 B2 12/2007 Swagerty et al.
7,312,075 B1 12/2007 Yamamura et al.
7,347,840 B2 3/2008 Findlay et al.
PP18,942 P2 6/2008 Boer
PP18,969 P2 6/2008 Boer
7,401,647 B2 7/2008 Baycroft et al.
7,478,679 B2 1/2009 Berzin et al.
7,490,666 B2 2/2009 Swagerty et al.
7,614,448 B2 11/2009 Swagerty et al.
7,615,355 B2 11/2009 Papadopoulos et al.
7,633,992 B1 12/2009 Miao et al.
7,730,940 B2 6/2010 Knippa et al.
7,743,824 B2 6/2010 Lam et al.
7,748,449 B2 7/2010 Bussear et al.
7,823,634 B2 11/2010 Chan et al.
7,861,775 B2 1/2011 Palmer et al.
7,900,697 B2 3/2011 Swagerty et al.
7,954,793 B2 6/2011 Weisbeck et al.
7,997,338 B2 8/2011 Foster et al.
8,087,459 B2 1/2012 Caldwell et al.
8,117,819 B2 2/2012 Scott
8,127,978 B2 3/2012 Castillo et al.
8,136,604 B2 3/2012 Jennings
8,157,006 B2 4/2012 Koleilat et al.
8,194,885 B2 6/2012 Brannmark et al.
8,225,861 B2 7/2012 Foster et al.
8,235,108 B2 8/2012 Lemme et al.
8,251,142 B2 8/2012 Hinkie
8,302,678 B2 11/2012 Swagerty et al.
8,327,943 B2 12/2012 Borak et al.
8,371,374 B2 2/2013 Foster et al.
8,396,667 B2 3/2013 Nutley et al.
8,397,802 B2 3/2013 Lembcke
8,506,932 B2 8/2013 Arstad et al.
8,550,156 B2 10/2013 Castillo et al.
8,646,533 B2 2/2014 Nguy et al.
8,674,637 B2 3/2014 Kamijo
8,678,406 B1 3/2014 Albertson
8,727,012 B2 5/2014 Bhat
8,794,310 B2 8/2014 Allen et al.
8,823,558 B2 9/2014 Barrett
8,833,473 B2 9/2014 McRobb et al.
8,899,316 B2 12/2014 Krawiec et al.
8,910,709 B2 12/2014 Thomson et al.
8,936,075 B2 1/2015 Guidry
9,051,539 B2 6/2015 Synder et al.
9,163,478 B2 10/2015 Broussard et al.
9,168,317 B2 10/2015 Jones
9,194,201 B2 11/2015 Simson et al.
9,200,498 B2 12/2015 Klimack
9,243,473 B2 1/2016 Yang et al.
9,284,812 B2 3/2016 Mazyar et al.
9,314,541 B2 4/2016 Jones
9,447,671 B2 9/2016 Nguyen et al.
9,523,256 B2 12/2016 Bilansky et al.
9,587,460 B2 3/2017 Clemens
9,637,997 B2 5/2017 Goodman et al.
9,695,659 B2 7/2017 Davis et al.
9,770,046 B2 9/2017 Negri
9,909,381 B2 3/2018 Kajaria et al.
9,925,825 B1 3/2018 Hoffman et al.
9,976,380 B2 5/2018 Davis et al.
10,060,283 B2 8/2018 Tomigashi et al.
10,132,141 B2 11/2018 Caccialupi et al.
10,159,841 B2 12/2018 Chin et al.
10,173,936 B2 1/2019 Flato et al.
10,230,430 B2 3/2019 Uchino et al.
10,287,846 B2 5/2019 Andersen et al.
10,319,092 B2 6/2019 Wu et al.
10,364,635 B2 7/2019 Puccio et al.
10,447,070 B2 10/2019 Qin et al.
10,450,832 B2 10/2019 Hickie
10,487,302 B2 11/2019 Spangenburg et al.
10,487,607 B2 11/2019 Kajaria et al.
10,604,693 B2 3/2020 Kim et al.
10,612,349 B2 4/2020 Clemens
10,633,966 B2 4/2020 Pollak et al.
10,655,423 B2 5/2020 Stein et al.
10,662,762 B2 5/2020 Alnughaimish et al.
10,677,011 B2 6/2020 Al-AbdulJabbar et al.
10,724,344 B2 7/2020 Dietz
10,738,560 B2 8/2020 Duan et al.
10,743,590 B2 8/2020 Moussa et al.
10,753,173 B2 8/2020 Voll et al.
10,780,659 B2 9/2020 Ahrenholtz
RE48,308 E 11/2020 Flato et al.
10,837,264 B2 11/2020 Filippov et al.
10,893,527 B2 1/2021 Lee et al.
10,947,813 B2 3/2021 Ejim et al.
10,966,224 B2 3/2021 Yu et al.
10,982,499 B2 4/2021 Alshuraim
11,041,357 B2 6/2021 Pounds
11,058,837 B2 7/2021 Stam et al.
11,096,194 B2 8/2021 Tang
11,142,732 B2 10/2021 Spangenburg et al.
11,174,700 B2 11/2021 Fripp et al.
11,193,357 B2 12/2021 Clemens
11,268,342 B2 3/2022 Andersen et al.
11,293,270 B2 4/2022 Malone et al.
11,299,955 B2 4/2022 Fripp et al.
11,365,599 B2 6/2022 Glaesman
11,437,156 B2 9/2022 Russell, II et al.
11,440,521 B2 9/2022 Thiel
11,739,615 B2 8/2023 Bolivar et al.
2002/0033261 A1 3/2002 Metcalfe
2002/0119942 A1 8/2002 Vogels et al.
2003/0047321 A1 3/2003 Coon
2003/0100100 A1 5/2003 Jacobs, Jr. et al.
2003/0116318 A1 6/2003 Metcalfe
2003/0157095 A1 8/2003 Papadopoulos et al.
2004/0031530 A1 2/2004 Duggan
2004/0210790 A1 10/2004 Moon et al.
2004/0238181 A1 12/2004 Cook et al.
2004/0256112 A1 12/2004 Harrall et al.
2005/0074885 A1 4/2005 Vogels et al.
2006/0106202 A1 5/2006 Papadopoulos et al.
2006/0238437 A1 10/2006 Huang
2008/0087440 A1 4/2008 Ring
2008/0177592 A1 7/2008 Masuyama et al.
2008/0202748 A1 8/2008 Bussear et al.
2008/0254372 A1 10/2008 Wu
2008/0254373 A1 10/2008 Wu
2010/0015114 A1 1/2010 Papadopoulos et al.
2010/0068779 A1 3/2010 Wells et al.
2010/0258311 A1 10/2010 Craig et al.
2011/0081295 A1 4/2011 Papadopoulos et al.
2012/0012343 A1 1/2012 Wilkin et al.
2012/0312560 A1 12/2012 Bahr et al.
2013/0105388 A1 5/2013 Johnson et al.

(56) References Cited

U.S. PATENT DOCUMENTS

| | | | |
|---|---|---|---|
| 2013/0140022 | A1 | 6/2013 | Leighton et al. |
| 2013/0288228 | A1 | 10/2013 | Anderson et al. |
| 2014/0058677 | A1 | 2/2014 | Combee |
| 2015/0012664 | A1 | 1/2015 | Johnson |
| 2015/0041126 | A1 | 2/2015 | Boyle et al. |
| 2015/0041129 | A1 | 2/2015 | Mani et al. |
| 2015/0073523 | A1 | 3/2015 | Chobotov |
| 2015/0090255 | A1 | 4/2015 | Gulliver et al. |
| 2015/0278138 | A1 | 10/2015 | Seidel et al. |
| 2015/0347246 | A1 | 12/2015 | Matsui et al. |
| 2015/0378937 | A1 | 12/2015 | Yang et al. |
| 2018/0124634 | A1 | 5/2018 | Jose et al. |
| 2018/0171740 | A1 | 6/2018 | Casanova |
| 2018/0313182 | A1 | 11/2018 | Cherewyk et al. |
| 2018/0355693 | A1 | 12/2018 | Al-AbdulJabbar et al. |
| 2019/0055839 | A1 | 2/2019 | Skillingstad et al. |
| 2019/0128115 | A1* | 5/2019 | AlNughaimish ..... E21B 47/07 |
| 2019/0234177 | A1* | 8/2019 | Silva ..... E21B 23/01 |
| 2019/0264527 | A1 | 8/2019 | Al-AbdulJabbar et al. |
| 2019/0321264 | A1 | 10/2019 | Gulliver et al. |
| 2020/0003032 | A1 | 1/2020 | Chen et al. |
| 2020/0375265 | A1 | 12/2020 | Moussa et al. |
| 2021/0108478 | A1 | 4/2021 | Filippov et al. |
| 2021/0108490 | A1 | 4/2021 | Filippov et al. |
| 2021/0293117 | A1 | 9/2021 | Bolivar et al. |
| 2021/0324699 | A1 | 10/2021 | Trumbull et al. |
| 2021/0370000 | A1 | 12/2021 | Stam et al. |
| 2022/0068512 | A1 | 3/2022 | Russell, II et al. |
| 2022/0081986 | A1 | 3/2022 | Roselier et al. |
| 2022/0086848 | A1 | 3/2022 | Sharma et al. |
| 2022/0299151 | A1 | 9/2022 | Lee et al. |
| 2024/0060400 | A1 | 2/2024 | Karakaya et al. |

* cited by examiner

COMPLETING AND WORKING OVER A WELLBORE

TECHNICAL FIELD

This disclosure relates to completing and working over a wellbore, in particular, one through which hydrocarbons are produced with a polished bore receptacle assembly.

BACKGROUND

Fluids, in the form of hydrocarbon and water, are trapped in reservoirs in subterranean formations. A wellbore is drilled through those subterranean formations to the reservoirs to flow the fluids to the surface of the Earth. A completion assembly is positioned in the wellbore to conduct the fluids to the surface of the Earth. The completion assembly can include tubulars. The flow of fluids and corrosion can wear, erode, and corrode the tubulars, requiring the wellbore to be re-completed by a workover operation.

SUMMARY

This disclosure describes systems and methods related to completing and working over a wellbore. This approach places a completion assembly having a left-hand threaded polished bore receptacle in the wellbore.

In one aspect, a wellbore completion assembly includes a polished bore receptacle, a torque lock ring, and a left-hand threaded coupling. The torque lock ring is positioned inside the polished bore receptacle. The torque lock ring couples the polished bore receptacle to an upper completion assembly. The left-hand threaded coupling is positioned inside the polished bore receptacle. The left-hand threaded coupling receives a left-hand threaded surface of the upper completion assembly.

In some embodiments, the wellbore completion assembly includes a debris protector coupled to the upper completion assembly. The debris protector extends about an uphole opening of the polished bore receptacle.

In some embodiments, the upper completion assembly includes a joint and an upper tubing. The joint has a first end a second end opposite the first end. The first end includes the left-hand threaded surface. The second end includes a right-hand threaded surface positioned on a second end. The upper tubing is coupled to the right-hand threaded surface the second end of the joint. In some cases, a torque required to couple the upper tubing to the joint is less than an opposing torque coupling the torque lock ring to the upper completion assembly.

In some embodiments, the wellbore completion assembly includes a lower tubing coupled to and extending from a downhole opening of the polished bore receptacle. The downhole opening is opposite an uphole opening of the polished bore receptacle.

In some embodiments, the torque lock ring has a torque lock ring first portion coupled to the polished bore receptacle and a torque lock ring second portion coupled to the upper completion assembly. In some cases, the wellbore completion assembly has multiple sealing surfaces. The sealing surfaces are a first seal and a second seal. The first seal is defined by the left-hand threaded coupling of the polished bore receptacle and the left-hand threaded surface of the upper completion assembly. The second seal is defined by the torque lock ring first portion and the torque lock ring second portion. Sometimes, the sealing surfaces are metal-to-metal seals.

In some embodiments, the torque lock ring is a degradable metal.

In some embodiments, the torque lock ring includes a surface to seal against the upper completion assembly.

In some embodiments, a top surface of the polished bore receptacle is angled to face a center axis of the polished bore receptacle.

In another aspect, a wellbore is completed and worked over. Completing and working over the wellbore includes disposing a lower completion assembly having a polished bore receptacle with an internal left-handed threaded surface in the wellbore, the wellbore formed from a surface of the Earth to a subterranean reservoir; contacting an upper completion assembly having a left-hand threaded coupling to the internal left-handed threaded surface of the polished bore receptacle; engaging the left-hand threaded coupling of the upper completion assembly to the internal left-handed threaded surface of the polished bore receptacle; rotating the upper completion assembly relative to the polished bore receptacle; and responsive to rotating the upper completion assembly relative to the polished bore receptacle, engaging the upper completion assembly to the polished bore receptacle.

In some embodiments, engaging the upper completion assembly to the polished bore receptacle includes forming a sealing surface between the upper completion assembly and the polished bore receptacle.

In some embodiments, disposing the lower completion assembly with the polished bore receptacle in the wellbore includes positioning the lower completion assembly with the polished bore receptacle in the wellbore; and cementing a portion of the lower completion assembly in the wellbore. A portion of the polished bore receptacle extends from the cement in an uphole direction.

In some embodiments, completing and working over the wellbore includes further includes determining a condition of the upper completion assembly; comparing the condition of the upper completion assembly to an expected condition to obtain a comparison result; and based on the comparison result, determining a degree of severity of tubing damage indicating the upper completion assembly requires replacement. In some cases, responsive to determining the degree of severity indicating the upper completion assembly requires replacement, completing and working over the wellbore includes further includes rotating the upper completion assembly requiring replacement relative to the polished bore receptacle; responsive to rotating the upper completion assembly requiring replacement relative to the polished bore receptacle; disconnecting the upper completion assembly from the polished bore receptacle; and removing the upper completion assembly requiring replacement from the wellbore. Sometimes, after removing the upper completion assembly requiring replacement from the wellbore, completing and working over the wellbore includes connecting another upper completion assembly comprising a left-hand threaded coupling to the internal left-handed threaded surface of the polished bore receptacle.

In yet another aspect, a wellbore is completed with a completion assembly. Completing the wellbore with the completion assembly includes providing a polished bore receptacle having a void extending from a polished bore receptacle-first end to a polished bore receptacle-second end opposite the polished bore receptacle-first end, the polished bore receptacle having a left-hand threaded surface on an internal surface of the void and a right-hand threaded surface on an outer surface of the polished bore receptacle; placing a joint in the void, the joint having a joint-first end having a left-hand threaded surface and a joint-second end having a right-hand threaded surface, the joint-second end opposite the joint-first end; contacting the left-hand threaded surface of the joint-first end to the left-hand threaded surface on the internal surface of the void; rotating the left-hand threaded surface of the joint-first end relative to the left-hand threaded surface on the internal surface of void; and responsive to rotating the left-hand threaded surface of the joint-first end relative to the left-hand threaded surface on the internal surface of void, connecting the joint to the polished bore receptacle.

In some embodiments, completing the wellbore with the completion assembly includes forming the left-handed threaded surface on the internal surface of the void proximal the polished bore receptacle-second end and forming the right-handed threaded surface on the outer surface of the polished bore receptacle proximal the polished bore receptacle-second end.

In some embodiments, a length of the completion assembly from the joint-second end to the polished bore receptacle-second end is between thirty and fifty feet.

In some embodiments, completing the wellbore with the completion assembly further includes placing a lower completion string in the wellbore; connecting the completion assembly to the lower completion string by the polished bore receptacle-second end at a surface of the Earth; running the completion assembly and the lower completion string into the wellbore; connecting an upper completion string to the completion assembly by the joint-second end at the surface; and running the upper completion string, the completion assembly, and the lower completion string farther into the wellbore in a downhole direction, the downhole direction from the surface toward a bottom hole location of the wellbore. In some cases, running the upper completion string, the completion assembly, and the lower completion string includes running the upper completion string, the completion assembly, and the lower completion string through the wellbore with the upper completion string, the completion assembly, and the lower completion string spaced apart from a casing in the wellbore.

In some embodiments, completing the wellbore with the completion assembly includes connecting the completion assembly to the lower completion string by the polished bore receptacle-second end further includes forming a first sealing surface between the lower completion string and the polished bore receptacle-second end; and connecting the upper completion string to the completion assembly by the joint-second end includes forming a second sealing surface between the upper completion string and the joint-second end. In some cases, the first sealing surface and the second sealing surface are metal-to-metal seals. In some cases, completing the wellbore with the completion assembly includes connecting the joint to the polished bore receptacle by a torque lock ring.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figures 1A, 1B, 1C:
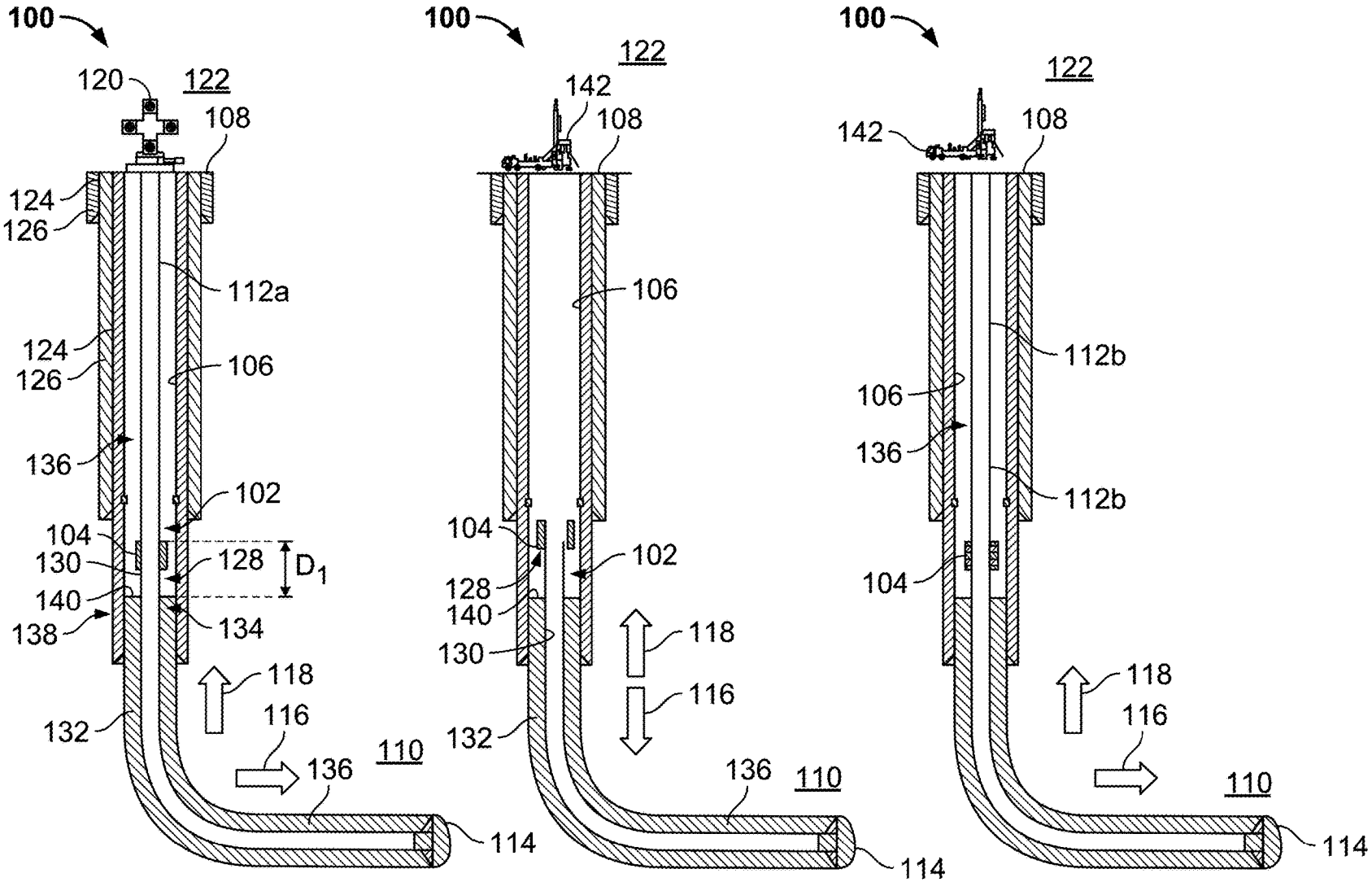
FIGS. 1A-1C are schematic views of a completion and workover operation in a well system using a wellbore completion assembly having a polished bore receptacle.

The present disclosure relates to completing and working over a wellbore with a wellbore completion assembly. The wellbore completion assembly has a polished bore receptacle which can be installed in the wellbore. The polished bore receptacle has a torque lock ring and a left-hand threaded coupling. The torque lock ring is positioned inside the polished bore receptacle to connect to and seal against an upper completion assembly. The left-hand threaded coupling is positioned inside the polished bore receptacle and receives a left-hand threaded surface of the upper completion assembly.

Implementations of the present disclosure can realize one or more of the following advantages. These systems and methods can reduce complexity of well construction. For example, a lower completion assembly with a left-hand threaded polished bore receptacle and production tubing extending from the polished bore receptacle can be placed in the wellbore. The wellbore can be cemented from the polished bore receptacle in a downhole direction towards a bottomhole of the wellbore, allowing a replaceable upper completion assembly along with the lower completion assembly with the polished bore receptacle to be placed in the wellbore in a single run, reducing the complexity of well construction and workover operations. Conventional polished bore receptacle systems are fill with cement up to the backside of the polished bore receptable. Such conventional polished bore receptacle systems include an expanding system and directly connect the outer casing string. The left-hand threaded polished bore receptacle described herein includes a cement column in the wellbore-left-hand threaded polished bore receptacle annulus at a height lower than the left-hand threaded polished bore receptacle and the left-hand polished bore receptacle is spaced apart from the outer casing. For example, installation and removal of completion assemblies with drill pipe can be eliminated, reducing complexity of well construction and workover operations.

For example, using the polished bore receptacle with the left-hand threaded internal surface can eliminate completion assembly connection with an inner surface of an outer casing of the wellbore, reducing complexity of well construction. For example, using the polished bore receptacle with the left-hand threaded internal surface can eliminate a scraper run for the inner surface of the outer casing, reducing complexity of well construction.

For example, a conventional completion can require a conventional polished bore receptacle to be set together with a slip system or a half mule shoe located on the bottom of the upper completion assembly. Conventional polished bore receptacle slips are set in the inner face of the outer casing. The left-hand threaded polished bore receptacle described herein can be set in the wellbore without the slip system. By placing the left-hand threaded polished bore receptacle in the wellbore, the slip system can be eliminated, eliminating pulling and apply tension, weight, or slack-off operations for setting the conventional polished bore receptacle to the casing, reducing complexity of well construction and workover operations.

For example, conventional completion operations can require high pressure or pressure cycling operations by ball drop or setting mechanism operations. By using the polished bore receptacle with the left-hand threaded internal surface to complete the wellbore, high pressure or pressure cycling operations can be eliminated, reducing complexity of well construction and workover operations.

For example, conventional completion operations can require a wireline entry sub-assembly or a half mule shoe to place a conventional polished bore receptacle in a wellbore. By establishing a flush inner diameter which is the same from the production tubing to the casing and eliminating any additional gap or space between the upper completion assembly to the inner completion during the first installation operation, this setup can simplify pump down operations and/or or running-in-hole/pulling-out-of-hole of other completion strings during the other operations. By using the polished bore receptacle with the left-hand threaded internal surface to complete the wellbore, the wireline entry sub-assembly and the half mule shoe can be eliminated, reducing complexity of well construction and workover operations.

Production tubing setting operations can be simplified, reducing complexity of well construction and workover operations. For example, by using the polished bore receptacle with the left-hand threaded internal surface, rotating of production tubing before, during, and after a cementing operation can be eliminated, reducing complexity of well construction and workover operations. For example, by using the polished bore receptacle with the left-hand threaded internal surface, pulling, slacking off, or other production tubing movement for setting the conventional polished bore receptacle can be eliminated, reducing complexity of well construction and workover operations. For example, by using the polished bore receptacle with the left-hand threaded internal surface, can eliminate use of a shear pin for conventional polished bore receptacle setting or releasing operations, reducing complexity of well construction and workover operations.

For example, an inner mandrel or stinger will no longer be needed for installation of a completion assembly. For example, some conventional polished bore receptacle systems have an inner elastomeric seal assembly. In some cases, such conventional polished bore receptacle systems can be run into the wellbore with inner elastomeric seal assembly and set with a drill pipe. Then, after pulling out the upper completion with the drill pipe from the inner elastomeric sealing assembly in the wellbore and stung in the conventional polished bore receptacle. Several sets of the seals (generally elastomers) are used for the inner mandrel/seal assembly for conventional polished bore receptacle systems. Eliminating the use of the inner mandrel and stinger by using the polished bore receptacle with the left-hand threaded internal surface can reduce complexity of well construction and workover operations.

These systems and methods can reduce complexity of workover operations. For example, the polished bore receptacle has polished internal surfaces and can be sized to allow the polished bore receptacle to swallow only a portion of the upper completion assembly having the left-hand threaded surface. Moreover the polished internal surfaces of the polished bore receptacle can reduce a corrosion of the completion assembly, simplifying connecting and disconnecting the upper completion assembly from the lower completion assembly, reducing complexity of workover operations.

These systems and methods can reduce complexity of assembly operations. For example, by using standard thread connections between the upper completion assembly and the lower completion assembly, tubing string set up assembly operations can be simplified. For example, the left-hand threaded polished bore receptacle can be prepared and assembled as a standard casing/tubing joint previously at a workshop. In some cases, the overall length is similar to a tubing length, reducing the complexity of assembly operations. In some cases, the overall length is transportable by truck from the workshop to the well site (the location of the wellbore) and while running in the wellbore, the initial casing/tubing string can be installed in the same manner as one of the single joint through the threaded couplings reducing the complexity of assembly operations.

For example, a debris protector can be placed about an uphole opening of the polished bore receptacle, reducing or preventing debris from the wellbore entering into the polished bore receptacle, which can impede or prevent the upper completion assembly from rotating relative to the lower completion during disconnecting operations, requiring excessive torque or cutting to remove the connection. Preventing or eliminating debris collecting in the polished bore receptacle can reduce complexity of workover operations.

For example, the torque lock ring can reduce or prevent cement from contacting the left-handed threads of the polished bore receptacle and the upper completion assembly which can impede or prevent the upper completion assembly from rotating relative to the lower completion during disconnecting operations, requiring excessive torque or cutting to remove the connection. Preventing or eliminating cement from contacting the left-handed threads of the polished bore receptacle and the upper completion assembly can allow the upper completion assembly to separate from the polished bore receptacle at the proper torque range, which can reduce complexity of workover operations by preventing over-torque damage to the polished bore receptacle or re-entry cutting operations to remove the polished bore assembly.

In some cases, complexity of workover operations can be reduced by the torque lock ring decreasing an amount of torque required to rotate the upper completion assembly relative to the lower completion assembly. For example, sometimes the torque lock ring is constructed from a degradable metal. The upper completion assembly can be connected to the polished bore receptacle by the left-hand threads and the torque lock ring. Following a time period, i.e., a few days, the torque lock ring can dissolve. After the torque lock ring dissolves, a lower amount of torque can be used to overcome the left-hand threads alone, reducing the total amount of torque required to disconnect the upper completion assembly from the polished bore receptacle, reducing the complexity of workover operations.

The left-hand threaded polished bore assembly may remain in the wellbore over several or many years in normal conditions, and not be exposed to any application of torque during the naturally flowing time period. For future completion operations, when required to disengage the upper completion assembly at that time, right-handed torque is still required to disengage the upper completion assembly from the lower completion assembly. After the torque lock ring dissolves, a lower amount of torque can be used to overcome the left-hand threads alone, reducing the total amount of torque required to disconnect the upper completion assembly from the polished bore receptacle, reducing the complexity of workover operations.

The number of trips into and out of the wellbore during workover operations can be reduced. For example, by using the left-hand threaded polished bore receptacle, only the damaged upper completion assembly needs to be tripped out of the hole, and a new un-damaged completion assembly can be tripped in the hole, reducing the number of trips required to recomplete the wellbore. Conventional polished bore receptacle systems can be run in the wellbore with drill pipe and set in the inner surface of the outer casings. Such operations require the drill pipe to be pulled out of the hole, a new clean scraper system to be run in hole to clean debris and cements from the top of the polished bore receptacle, and then the upper completion assembly to be run in the wellbore. By using the left-handed threaded polished bore receptacle, these operations can be all eliminating, and reducing the complexity of workover operations.

For example, by using the left-hand threaded polished bore receptacle new barrier string requirements can be reduced or eliminated, reducing the complexity of workover operations.

These systems and methods can increase wellbore production of oil and gas. For example, conventional solutions to recompleting wellbores such as installing a reduced diameter to bypass tubing damage, patching damage with a mechanical internal casing patch, cutting and tapping the existing tubing, or installing a conventional polished bore receptacle with packer below damaged tubing can reduce flow of oil and gas from the wellbore to the surface for production and refinement. By completing the wellbore with a left-hand threaded polished bore receptacle, the upper completion assembly with damaged components can be rotated (for example, right-hand rotation from the surface by a workover rig) to separate from the left-handed threaded polished bore receptacle, removed from the wellbore, and replaced with a new upper completion assembly coupled to the existing left-hand threaded polished bore receptacle, increasing wellbore production of oil and gas. Production of oil and gas can be increased because left-handed polished bore receptacle has a constant inner diameter (i.e., the inner diameter of the polished bore receptacle does not have a reduction in internal diameter).

These systems and methods can increase well and well component life. For example, some conventional solutions to tubing damage can accelerate additional damage, reducing well and well component life, such as placing a conventional polished bore receptacle with a packer above the initial damage in an uphole direction toward a surface and leaving a gap between the cemented pipe can expose casing and wellbore components to corrosive and abrasive fluids, decreasing well and well component life. By completing the wellbore with a left-hand threaded polished bore receptacle, the upper completion assembly with damaged components can be rotated to separate from the left-handed threaded polished bore receptacle, removed from the wellbore, and replaced with a new upper completion assembly coupled to the existing left-hand threaded polished bore receptacle, increasing well and well component life.

For example, by placing the left-hand threaded polished bore receptacle in the wellbore to complete the wellbore, a grapple, slips, or biting of the production tubing can be eliminated. Grappling, slips, or biting of the production tubing can damage the production tubing, reducing life of the production tubing. By eliminating the need to grapple or bite the production tubing, the life of the production tubing can be increased.

These systems and methods can improve completion assembly sealing. For example, sealing an upper completion assembly to the lower completion assembly with the left-hand threaded polished bore receptacle by the left-hand threads and the torque lock ring can eliminate elastomeric seals, and only use metal-to-metal sealing surfaces, improving sealing of the completion assembly. For example, by using the similar thread sizes and configurations for the completion string, higher pressures can be applied to handle and perform hydraulic fracturing operations.

FIGS. 1A-1C are schematic views of a completion and workover operation in a well system 100 using a wellbore completion assembly 102 with a polished bore receptacle 104. The polished bore receptacle 104 is left-hand threaded and is described in more detail in reference to FIGS. 2A-2F. The well system 100 includes a wellbore 106 which extends from a surface 108 of the Earth to control the flow of fluids in the form of liquids and gases such as water and hydrocarbons from subterranean formations 110 to the surface 108 for production, refining, and industrial utilization.

The wellbore 106 has a bottom hole location (i.e., the bottom hole) 114. The bottom hole 114 is in a downhole direction, shown by arrow 116, away from the surface of 108. The surface 108 is in an uphole direction, shown by arrow 118, from the bottom hole location 114.

FIG. 1A is a schematic view of the completion and workover operation after drilling and completing the well system 100 with a first (initial) upper completion assembly 112*a* rotatably coupled to the polished bore receptacle 104. The upper completion assembly 112 a can be referred to as an upper completion string. The polished bore receptacle 104 is part of a lower completion assembly 128. The lower completion assembly 128 can be referred to as lower completion string. The upper completion assembly 112*a* includes multiple production tubulars. The upper completion assembly 112*a* extends to the surface 108. The lower completion assembly 128 followed by the upper completion assembly 112*a* are run the wellbore 106 during the initial completion operation. The first upper completion assembly 112*a* can become damaged by wear or corrosion over time and require replacement.

The lower completion assembly 128 includes production tubing 130 extending from the polished bore receptacle 104 in the downhole direction 116. The production tubing 130 receive the liquids and gases including hydrocarbons and water (formation fluids) from the subterranean formations 110 and conduct the formation fluids in the uphole direction. Generally, when a portion of the wellbore completion assembly 102 is permanently installed (that is, not readily removable by common workover operations) it can be referred to as a lower completion or lower casing. Generally, when a portion of the wellbore completion assembly 102 is removable using common workover operations, it can be referred to as tubing. In some cases, a partially cemented long string without conventional polished bore receptacle systems with a cemented section is casing and referred to as the lower completion and the non-cemented section is tubing and referred to as the upper completion.

The well system 100 has a wellhead assembly 120 coupled to the wellbore 106. The wellhead assembly 120 seals the wellbore 106 from the surrounding environment 122 and seals around components entering and exiting the wellbore 106. Also, the wellhead assembly 120 controls the flow of fluids and into and out of the wellbore 106.

The well system 100 has multiple casings 124 and cement 126 positioned in the wellbore 106. The casings 124 and cement 126 seal the wellbore 106 from one or more of the subterranean formations 110.

The wellbore 106 is drilled and completed by a drilling rig (not shown in FIG. 1A, but shown and described in reference to FIG. 1C). The drilling rig completes the well system 100 after drilling the wellbore 106. The upper completion assembly 112*a* is rotatably coupled to the left-hand threads (described in reference to FIGS. 2A-2F) of the polished bore receptacle 104 on the surface 108. In some cases, a portion of the upper assembly 112*a* can be coupled to the polished bore receptacle 104 at a workshop and the assembly transported to the well system 100. The lower completion assembly 128 with the polished bore receptacle 104, along with the upper completion assembly 112*a*, are positioned in the wellbore 106. The drilling rig conducts cement 132 into the wellbore 106 to fill a portion 134 of an annulus 136 defined by the wellbore 106 and the lower completion assembly 128 up to a location 138 below the polished bore receptacle 104. The cement 132 fills the annulus 136 to a distance $D_1$ below the polished bore receptacle 104. In other words, some production tubing 130 of the lower completion assembly 128 extends from the cement 132. The cement 132 is spaced apart from the polished bore receptacle 104. In some cases, the polished bore receptacle 104 is separated from a top 140 of the cement 132 by approximately 100 to 500 feet ($D_1$ is between approximately 100 to 500 ft).

Over the life of the well system 100, formation fluids flow from the subterranean formations 110 into the wellbore 106 and into the production tubing 130 of the lower completion assembly 128. The wellbore fluids flow from the lower completion assembly 128 to the upper completion assembly 112*a*, and to the surface 108 in the direction of arrow 118. The formation fluids can include corrosive chemicals such as $H_2S$, $CO_2$, high salinity brines, enhanced production chemicals (acids used during intervention) and abrasive fluids such as sand and solid laden production fluids. The corrosive chemicals, corrosive well fluids, abrasive solids, and abrasive fluids can adversely impact the structural integrity of the upper completion assembly 112*a* to produce production tubing damage. For example, the production tubing damage can include one or more of a reduction in tubing wall thickness, an internal diameter expansion, an internal diameter reduction, an external diameter expansion, an external diameter reduction, a pipe ovality change, a pinhole leak, a corrosion level, an erosion level, a material embrittlement, or a crack.

In some cases, the upper completion assembly 112*a* wears preferentially over the lower production tubing 128. For example, oxygen reachability from the atmosphere to upper part of the tubing is one of them. For example, the presence of some corrosive gases like as $CO_2$ can contribute to the preferential corrosion of the upper completion assembly 112*a*. $CO_2$ gas can be a more active gas at shallow depths due to pressure effects and temperature effects affecting reaction rates.

The well system 100 is evaluated to determine the condition (the structural integrity) of the well system 100 components by conducting a logging operation to identify an onset and a degree of severity of production tubing damage. For example, flow surveys, density, capacitance, x-ray inspection, gamma ray inspection, bond logs, calipers, and visual (camera) logging can be conducted to inspect the well system 100, especially the upper completion assembly 112*a*. Multiple features are measured and inspected. Once a severely damaged tubing segment above the cemented section is detected, cutting and recovering the production tubing from above the cemented section and running a new replacement tubing becomes one of the most cost-effective solutions to ensure a sustained well integrity and prolonged well life. Each of the dimensions, conditions, and features are compared to initial dimensions, initial conditions, and features (i.e., expected conditions).

Based on the comparison result, a degree of severity of tubing damage is determined. In some cases, the degree of severity indicates the upper completion assembly requires replacement. For example, the degree of severity can indicate that the upper completion assembly may fail within a period of time or has already failed (a leak could occur in the period of time or the leak has already occurred). For example, the degree of severity can indicate a dimension of the upper completion assembly 112*a* has changed resulting in a flow restriction (i.e., the ovality change or a buildup of corrosion).

In some cases, a controller (not shown) performs the comparison, determines the comparison result indicating the degree of severity, and determines the upper completion assembly requires replacement. For example, in some implementations, the controller is separate from the logging tools and receives data from logging tools performing the logging operations performs the comparison. In other implementations, the logging tools include the controller.

The controller can include various forms of digital computers, such as printed circuit boards (PCB), processors, digital circuitry, or otherwise parts of a fracture geometry mapping system. Additionally, the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller can include a processor, a memory, a storage device, and an input/output device which can be interconnected using a system bus. The processor is capable of processing instructions for execution within the controller. The processor is capable of processing instructions stored in the memory or on the storage device to display graphical information for a user interface on the input/output device. The memory stores information within the controller. The storage device is capable of providing mass storage for the controller. The input/output device provides input/output operations for the controller. The features described can be implemented in digital electronic circuitry, or in computer hardware, firmware, software, or in combinations of them. The apparatus can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output.

FIG. 1B is a schematic view of the completion and workover operation after determining the upper completion assembly 112*a* requires replacement. A workover rig 142 is positioned relative to the wellbore 106 to remove the upper completion assembly 112*a*. The workover rig 142 rotates the upper completion assembly 112*a* relative to the left-hand threaded polished bore receptacle 104 to disconnect the upper completion assembly 112*a* from the polished bore receptacle 104. For example, the workover rig 142 can rotate the upper completion assembly 112*a* by applying right hand torque from surface 108 and upper completion assembly 112*a* can disconnect from the lower completion assembly 128 through left hand threads (installed during the initial completion operation). The workover rig 142 then removes the upper completion assembly 112*a* from the wellbore 106 in the direction of arrow 118. The polished bore receptacle 104 and the production tubing 130 (the lower completion assembly 128) is fixed (stays/remains) in the wellbore 106.

FIG. 1C is a schematic view of the completion and workover operation placing connecting another upper completion assembly 112*b* on the left-hand threaded polished bore receptacle 104. The workover rig 142 trips another upper completion assembly 112*b* (new, undamaged) into the wellbore 106 in the direction of arrow 116 (also shown in FIG. 2C). The upper completion assembly 112*b* is substantially similar to the upper completion assembly 112*a*. The new upper completion assembly 112*b* contacts the left-hand threaded polished bore receptacle 104. The workover rig 142 rotates the upper completion assembly 112*b* to connect the upper completion assembly 112*b* to the left-hand threaded polished bore receptacle 104 (also shown in FIGS. 2D and 2F). In some cases, the left-hand threads can be sized and spaced different than the right-hand threads. Sometimes, the left-hand threads are thicker (wider) and/or spaced farther apart from one another than the right-hand threads of the other connections. For example, the left-hand threads can be ACME threads. Coupling the upper completion assembly 112*b* to the lower completion assembly 128 with the left-hand threaded polished bore receptacle 104 can improve the engaging and disengaging of the upper completion assembly 112*b* to and from the lower completion assembly 128.

FIGS. 2A-2F are schematic views of the wellbore completion assembly 102 of FIGS. 1A-1C. The wellbore completion assembly 102 includes the upper completion assembly 112*a* connected to the lower completion assembly 128 described in reference to FIGS. 1A-1C. The upper completion assembly 112*a* rotates in a first direction 234 (shown in FIG. 1D) to engage the upper completion assembly 112*a* to the left-hand threaded polished bore receptacle 104. Referring to FIG. 1A, the upper completion assembly 112*a* rotates in a second direction 208 opposite the first direction 234 to dis-engage the upper completion assembly 112*a* from the left-hand threaded polished bore receptacle 104.

The upper completion assembly 112*a* has multiple production tubes (tubing, pipes) 202. The production tubes 202 are coupled end to end to extend to the surface 108 (shown in FIGS. 1A and 1C). The production tubes 202 receive the wellbore fluids from the lower completion assembly 128 and conduct the wellbore fluids to the surface 108. The production tubes 202 are right-hand threaded. The production tubes 202 can have right handed couplings 204 connecting each of the production tubes 202 to one another.

The upper completion assembly 112*a* includes a debris protector 210 coupled to one of the production tubes 202. The debris protector 210 extends from the production tube 202 in the downhole direction 116 about an uphole opening 212 of the polished bore receptacle 104. The debris protector 210 can reduce an amount or prevent foreign objects or debris (not shown) from the annulus 136 entering the polished bore receptacle 104. The debris protector 210 can be constructed from a metal. In some cases, during the assembly or installation process, a space defined by the joint 214, the left-hand threaded polished bore receptacle 104, and below the debris protector 210 can be filled with a fluid having a corrosion inhibitor to reduce or limit corrosion of the left-handed polished bore receptacle 104. For example, the fluid can be a liquid or a gel. An outer diameter debris protector is less than an inner diameter of the wellbore 106, for example, an inner casing.

The upper completion assembly 112*a* includes joint 214 coupling the production tubes 202 (right-hand threaded) to the polished bore receptacle 104 (left-hand threaded). The joint 214 has a first end 216 and a second end 218 opposite the first end. The first end 216 is coupled to one of the production tubes 202. The first end 216 is right-hand threaded. In some cases, the first end 216 is referred to as the uphole end or upper end. The second end 218 is coupled to the polished bore receptacle 104. The second end 218 is left-hand threaded to couple to the polished bore receptacle 104. In some cases, the second end 218 is referred to as the downhole end, upper end, or lower end. Some or all of joint 214 can be positioned in the polished bore receptacle 104. In some cases, the joint 214 extends through the opening 212 and couples to the production tube 202 in the uphole direction 118 from the opening 212. In some cases, the debris protector 210 is coupled to the joint 214. The right-hand threads of the first end 216 (the upper threads) can be the same as all uphole upper completion assembly 112*a* threads. The left-hand threads of the second end 218 (the bottom threads can be the same type of thread as the rest of the upper completion assembly 112*a*, but aligned to couple left-handed. In some cases, the left-hand threads have a same or a similar loading capacity, torque ratings, and make-up space as the right-hand threads.

The polished bore receptacle 104 has a top surface 220 defining the opening 212. In some cases, the top surface 220 is angled toward a center axis 222 of the polished bore receptacle 104. The angled top surface 220 can aid in directing another upper completion assembly 112*b* into the polished bore receptacle 104.

Figure 2A:
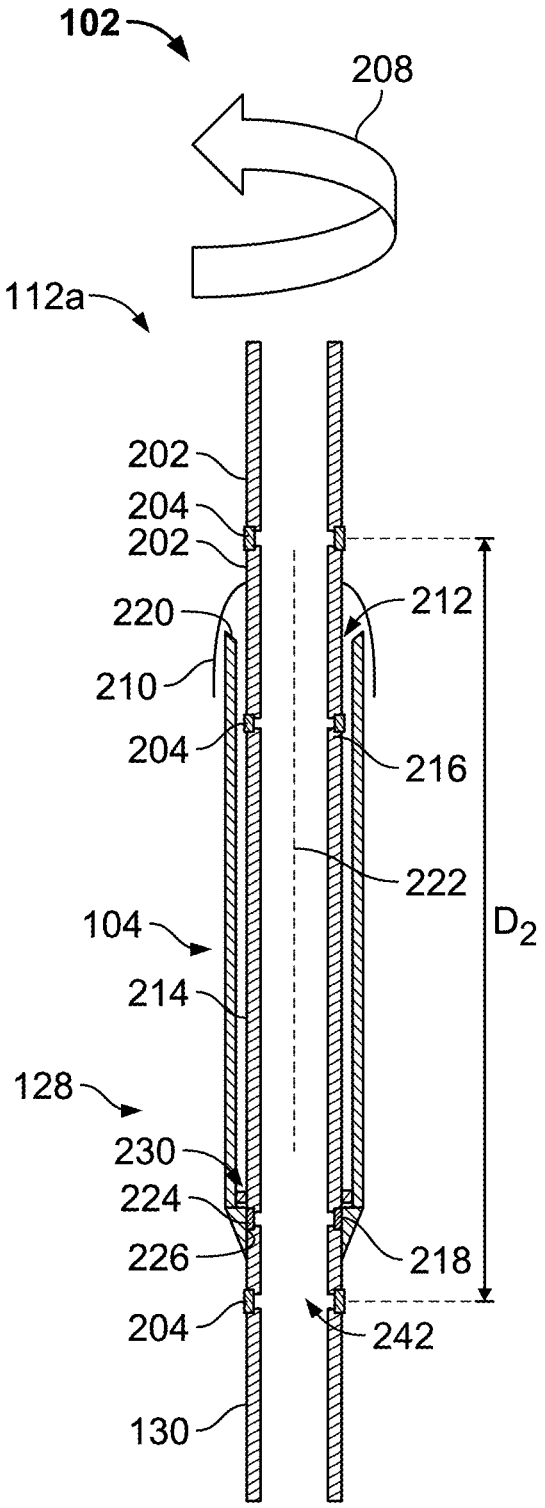
FIGS. 2A-2F are schematic views of the wellbore completion assembly of FIGS. 1A-1C.
Figure 2B:
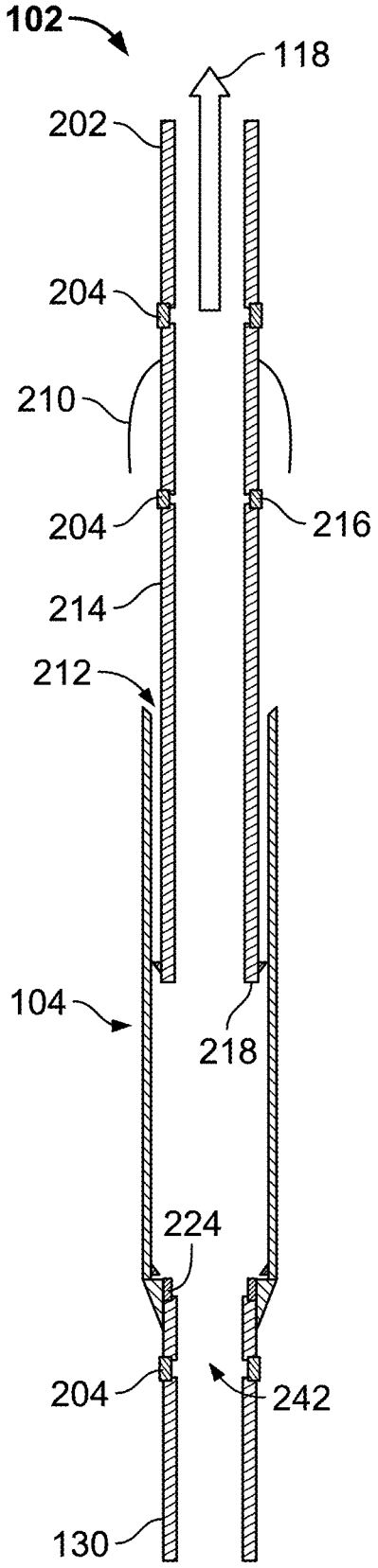
Figure 2C:
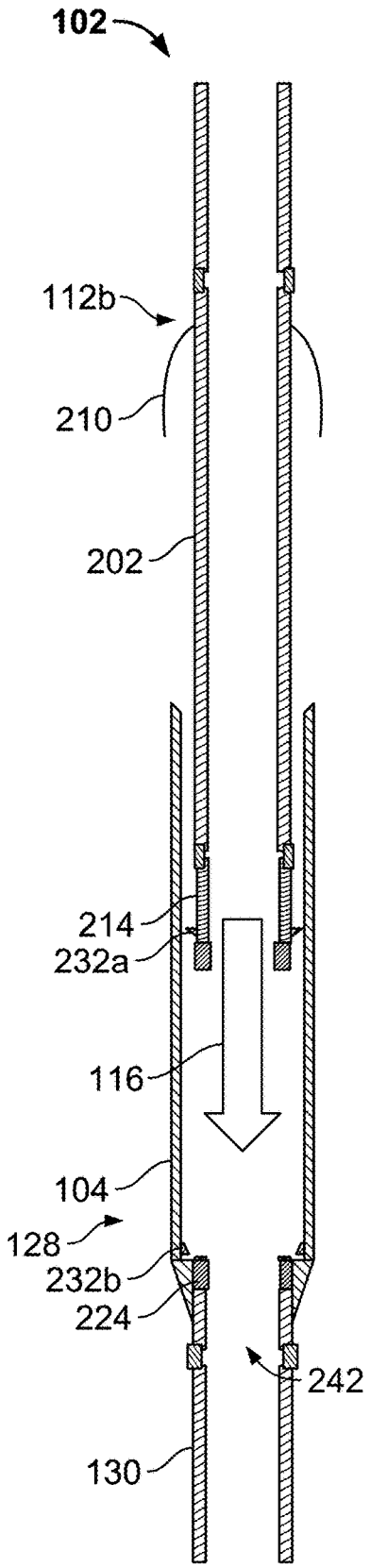
Figure 2D:
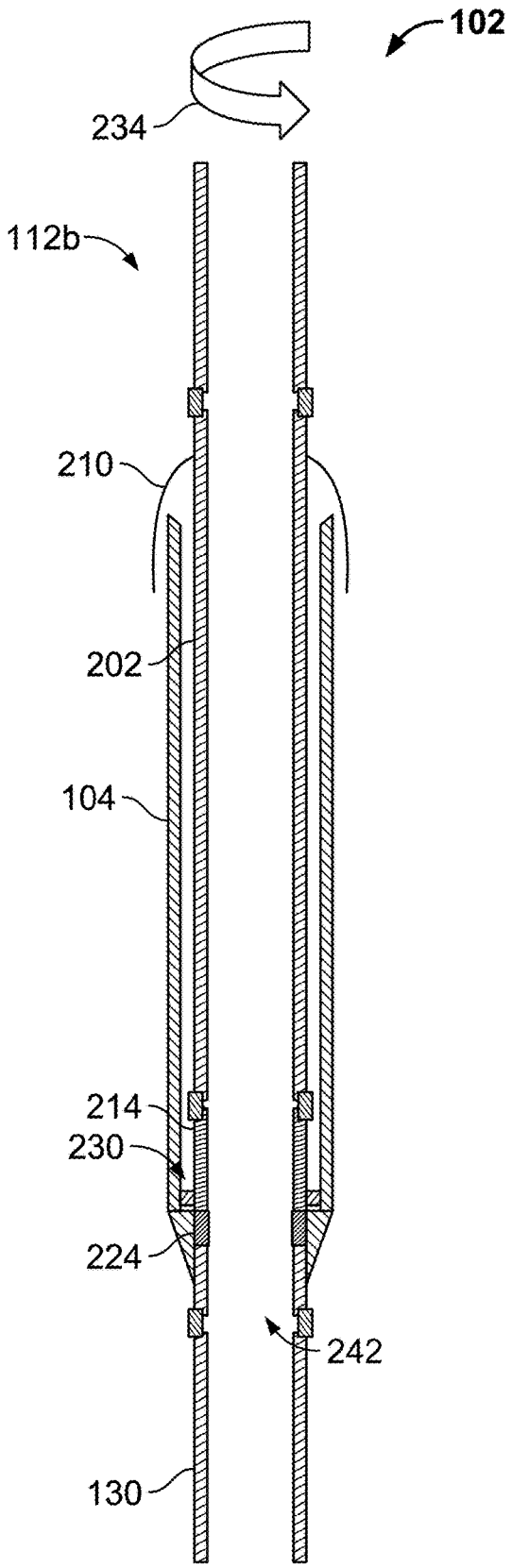

Referring to FIGS. 2B-2C, the polished bore receptacle 104 has a void 238 extending from the top surface 220 to a bottom surface 240 of the polished bore receptacle 104. The void 238 extends from the opening 212 (an uphole opening) to another opening 242 (a downhole opening) of the polished bore receptacle 104.

The lower completion assembly 128 has a left-hand threaded coupling 224 positioned inside the polished bore receptacle 104. The left-hand threaded coupling 224 receives the left-hand threaded surface (the second end 218 of the joint 214). The polished bore receptacle is coupled the left-hand threaded coupling 224. In some cases, the left-hand threads are located on an inner surface 226 of the polished bore receptacle 104. The threads of the left-hand threaded coupling 224 and the left-hand threads of the second end 218 of the joint 214 define a first sealing surface 228 (shown in FIG. 2F).

In some cases, the only single left-hand threads will be at the connection between the lower completion assembly 128 and upper completion assembly 112*a*. When separating lower completion assembly 128 and upper completion assembly 112*a*, right-hand torque from the surface is applied on the upper completion assembly 112*a* and all the other right-hand threaded connections will be forced to tighten more while only one joint in the well system 100, the left-handed polished bore receptacle 104 will be forced to disconnect.

Figure 2F:
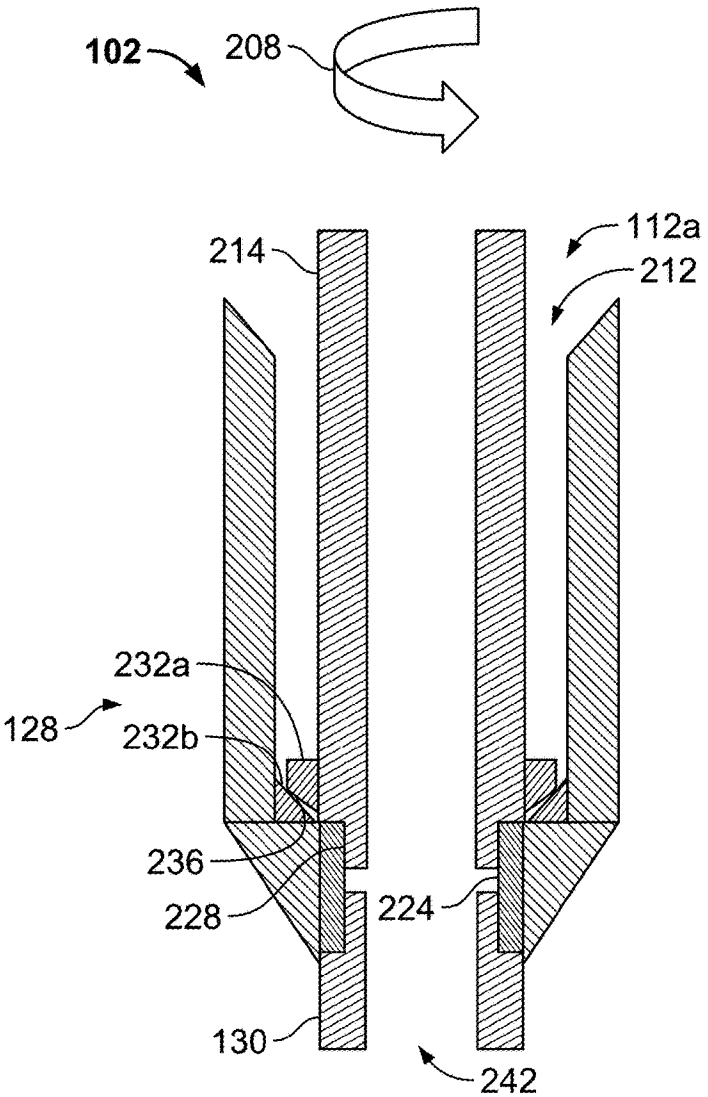
Figure 2E:
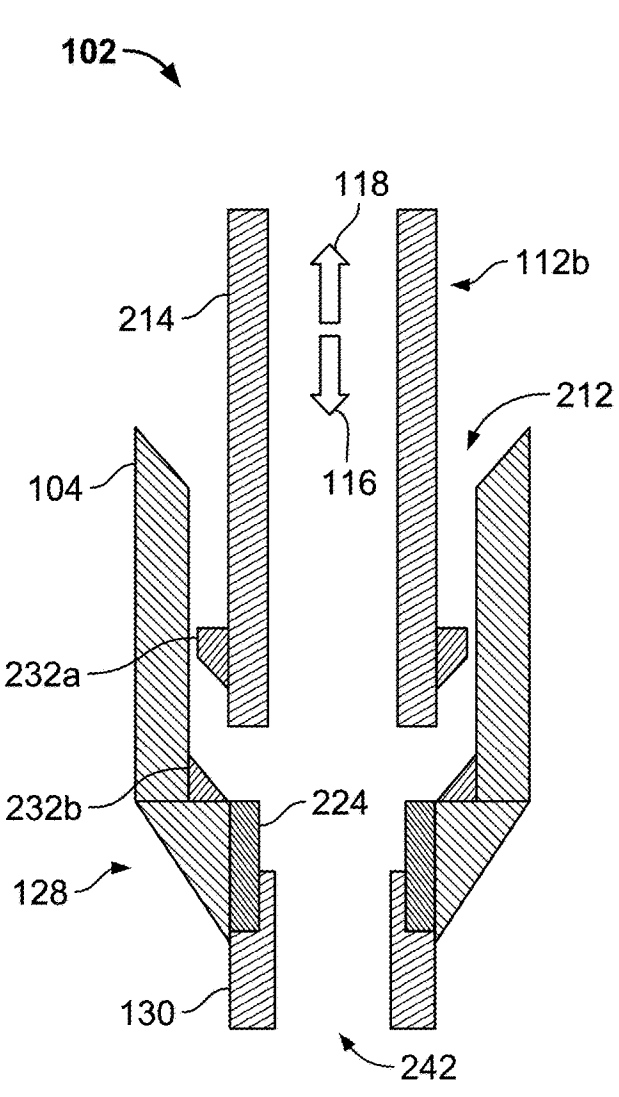

The lower completion assembly 128 includes a torque lock ring 230 positioned inside the polished bore receptacle 104 to seal the polished bore receptacle 104 to the upper completion assembly 112*a*. Referring to FIGS. 2E-2F, the torque lock ring 230 has a first portion 232*a* and a second portion 232*b*. The first portion 232*a* is coupled to the upper completion assembly 112*a*. For example, the first portion 232*a* can be coupled to the joint 214. The second portion 232*b* is coupled to the polished bore receptacle 104. Referring to FIG. 2F, the first portion 232*a* of the torque lock ring 230 and the second portion 232*b* of the torque lock ring 230 define a second sealing surface 236.

In some cases, the torque lock ring 230 can help to seal against the upper completion assembly 112*a*. In some cases, the torque lock ring 230 connecting the upper completion assembly 112*a* can reduce or eliminate the unwanted disconnect situations. During the initial installation of wellbore completion assembly 102 in the wellbore 106, the wellbore completion assembly 102 can encounter tight spots requiring the wellbore completion assembly to reciprocate in the uphole direction 118 and the downhole direction 116, along with rotating, to pass through those tight spots. During reciprocating and rotating in the initial installation operation, the wellbore completion assembly 102 may disconnect. The torque lock ring 230 can reduce or eliminate disconnecting from the left hand thread while the wellbore completion assembly 102 is rotated in a right-hand direction. Once the wellbore completion assembly 102 is installed in the wellbore 106, the torque lock ring 230 can degrade, in some cases within three to five days, upon exposure to wellbore conditions to enable subsequent completion operations.

In some cases, the only sealing surfaces between the upper completion assembly 112 and the lower completion assembly 128 are the first sealing surface 228 and the second sealing surface 236. In some cases, the only sealing surfaces between the upper completion assembly 112 and the lower completion assembly 128 is the first sealing surface 228. In some cases, the only sealing surfaces are metal-to-metal.

The torque lock ring 230 can be constructed from metal. In some cases, the torque lock ring is degradable metal. For example, after the first portion 232*a* of the torque lock ring 230 is coupled to the second portion 232*b* of the torque lock ring 230 in the wellbore 106 and a period of time has passed, the torque lock ring 230 can begin to decompose or disintegrate, or in some cases, fully or completely decompose or disintegrate.

Referring to FIG. 2A, in some cases, some of the components can be assembled as a wellbore completion sub-assembly, separate from the production tubing 202, 130 at the workshop. For example, the wellbore completion sub-assembly can include a portion of the upper completion assembly 112*a* and a portion of the lower completion assembly 128. The portion of the upper completion assembly 112*a* can be the joint 214 with the debris protector 210. The portion of the lower completion assembly 128 can include the polished bore receptacle 104, the torque lock ring 230, and the left-handed threaded coupling 224. The portion of the upper completion assembly 112*a* can be coupled to and torqued to the portion of the lower completion assembly 128 at the workshop, and then transported to the well system 100 for positioning in the wellbore during completion operations. The assembly operations can include conducting a pressure test across the left-hand threads connecting the joint 214 to the left-hand threaded polished bore receptacle 104 to ensure a sufficient fluid seal is established between the left-hand threads. In some cases, an overall length $D_2$ of the wellbore completion sub-assembly equal to or less than one full casing joint (i.e., approximately 30-50 feet).

Figure 3:
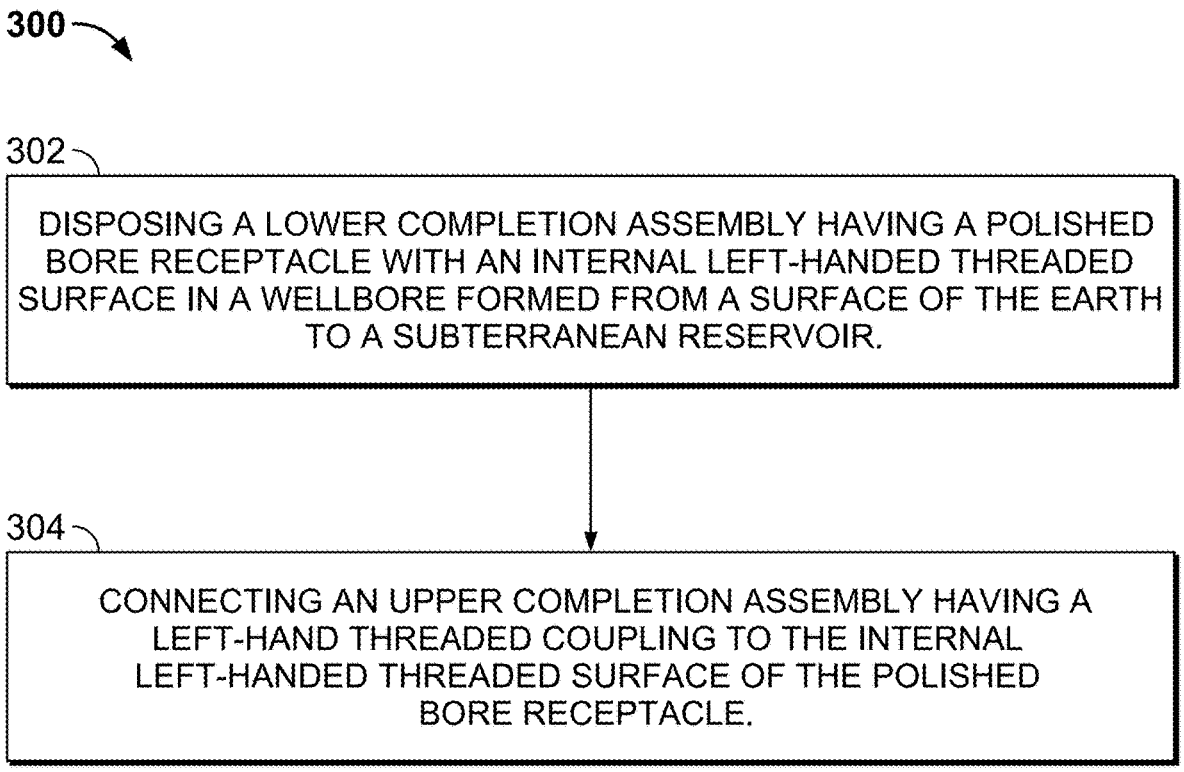
FIG. 3 is a flow chart of completing and working over a well system.

FIG. 3 is a flow chart 300 of an example method of completing and working over a wellbore according to the implementations of the present disclosure. At 302, a lower completion assembly having a polished bore receptacle with an internal left-handed threaded surface is disposed in a wellbore formed from a surface of the Earth to a subterranean reservoir. For example, referring to FIGS. 1A-1C, the lower completion assembly 128 includes polished bore receptacle 104 with the left-hand threaded coupling 224. The lower completion assembly 128 is placed in the wellbore 106.

In some implementations, disposing the lower completion assembly having the polished bore receptacle in the wellbore includes positioning the lower completion assembly having the polished bore receptacle in the wellbore; and cementing a portion of the lower completion assembly in the wellbore with a portion of the polished bore receptacle extending from the cement in an uphole direction. For example, referring to FIG. 1A, the drilling rig can place the cement 132 in the annulus 136, with the polished bore receptacle 104 above the top 140 of the cement 132.

At 304, an upper completion assembly having a left-hand threaded coupling is connected to the internal left-handed threaded surface of the polished bore receptacle. For example, referring to FIG. 1A, the drilling rig couples the second end 218 of the joint 214 to the left-hand threaded coupling 224 of the polished bore receptacle 104.

In some implementations, connecting the upper completion assembly having the left-hand threaded coupling to the internal left-handed threaded surface of the polished bore receptacle includes contacting left-hand threaded coupling of the upper completion assembly to the internal left-handed threaded surface of the polished bore receptacle; rotating the upper completion assembly relative to the polished bore receptacle; and responsive to rotating the upper completion assembly relative to the polished bore receptacle, engaging the upper completion assembly to the polished bore receptacle. For example, referring to FIG. 2D, the drilling rig rotates the upper completion assembly 112*b* in the direction of arrow 234 to connect the upper completion assembly 112*b* to the left-handed polished bore receptacle 104. The downhole end of the new upper completion assembly 112*b* can include another torque lock ring 230 to further seal and engage the new upper completion assembly 112*b* to the left-handed polished bore receptacle 104.

In some implementations, completing and working over the wellbore further includes determining a condition of the upper completion assembly; comparing the condition of the upper completion assembly to an expected condition to obtain a comparison result; and based on the comparison result, determining a degree of severity of tubing damage indicating the upper completion assembly requires replacement. For example, when the upper completion assembly 112*a* has been logged, and the conditions of the upper completion assembly 112 indicate a degree of severity (damage) above a threshold, the upper completion assembly 112*a* requires replacement.

In some cases, responsive to determining the degree of severity indicating the upper completion assembly requires replacement, completing and working over the wellbore further includes rotating the upper completion assembly requiring replacement relative to the polished bore receptacle; responsive to rotating the upper completion assembly requiring replacement relative to the polished bore receptacle; disconnecting the upper completion assembly from the polished bore receptacle; and removing the upper completion assembly requiring replacement from the wellbore. For example, referring to FIGS. 1B and 2A-2B, the upper completion assembly 112*a* is rotated in the direction of arrow 208 to disconnect the upper completion assembly 112*a* from the polished bore receptacle 104. The upper completion assembly 112*a* is moved by the workover rig 142 in the direction of arrow 118 to remove the upper completion assembly 112 from the wellbore 106.

In some cases, after removing the upper completion assembly requiring replacement from the wellbore, the completing and working over the wellbore further includes connecting another upper completion assembly having a left-hand threaded coupling to the internal left-handed threaded surface of the polished bore receptacle. For example, referring to FIGS. 1C, and 2C-2F, the workover rig 142 trips in the new upper completion assembly 112*b* into the wellbore 106 and connects the new upper completion assembly 112*b* to the polished bore receptacle 104.

In some implementations, the upper completion assembly 112*a* can include a packer (not shown) positioned proximal the joint 214 and set with a slip (not shown) to further couple to and inside the left-handed polished bore receptacle 104. In some cases, the packer can include elastomers to seal inside the left-handed polished bore receptacle 104. The slip can connect the upper completion assembly 112*a* to inner portions of the left-handed polished bore receptacle 104. A sealing element on the packer/slip system can establish another seal between the lower completion assembly 112*a* and the upper completion assembly 128. Since the inner diameter of the polished bore receptacle 104 is greater than the outer diameter the upper completion assembly 112*a*, a new engagement between the upper completion assembly 112*a* and the lower completion assembly 128 can be established without reducing the internal diameter of the wellbore completion assembly 102.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The invention claimed is:

1. A wellbore completion assembly comprising:

an upper completion assembly comprising a joint comprising:

a left-hand threaded surface on a first end of the joint; and a right-hand threaded surface on a second end of the joint, the second end opposite the first end;

a polished bore receptacle defining a void extending from an uphole opening of the polished bore receptacle to a downhole opening of the polished bore receptacle;

a torque lock ring positioned inside the void of the polished bore receptacle, the torque lock ring configured to couple the polished bore receptacle to the joint of the upper completion assembly uphole from the first end of the joint and within the polished bore receptacle; and a left-hand threaded coupling positioned inside the polished bore receptacle downhole from the torque lock ring, the left-hand threaded coupling configured to receive and connect to the left-hand threaded surface on the first end of the joint of the upper completion assembly.

2. The wellbore completion assembly of claim 1, further comprising a debris protector coupled to the upper completion assembly, the debris protector extending about the uphole opening of the polished bore receptacle.

3. The wellbore completion assembly of claim 1, wherein the upper completion assembly further comprises:

an upper tubing coupled to the right-hand threaded surface the second end of the joint.

4. The wellbore completion assembly of claim 3, wherein a torque required to couple the upper tubing to the joint is less than an opposing torque coupling the torque lock ring to the upper completion assembly.

5. The wellbore completion assembly of claim 1, further comprising a lower tubing coupled to and extending from the downhole opening of the polished bore receptacle, the downhole opening opposite the uphole opening of the polished bore receptacle.

6. The wellbore completion assembly of claim 1, wherein the torque lock ring comprises a torque lock ring first portion coupled to the polished bore receptacle and a torque lock ring second portion coupled to the upper completion assembly.

7. The wellbore completion assembly of claim 6, wherein a plurality of sealing surfaces of the wellbore completion assembly comprises:

a first seal defined by the left-hand threaded coupling of the polished bore receptacle and the left-hand threaded surface on the first end of the joint of the upper completion assembly; and a second seal defined by the torque lock ring first portion and the torque lock ring second portion.

8. The wellbore completion assembly of claim 7, wherein the plurality of sealing surfaces comprises metal-to-metal seals.

9. The wellbore completion assembly of claim 1, wherein the torque lock ring comprises a degradable metal.

10. The wellbore completion assembly of claim 1, wherein the torque lock ring comprises a surface configured to seal against the upper completion assembly.

11. The wellbore completion assembly of claim 1, wherein a top surface of the polished bore receptacle is angled to face a center axis of the polished bore receptacle.

12. A method for completing and working over a wellbore comprising:

disposing a lower completion assembly comprising a polished bore receptacle having an internal left-handed threaded surface and a torque lock ring first portion in the wellbore, the wellbore formed from a surface of the Earth to a subterranean reservoir;

contacting an upper completion assembly comprising a torque lock ring second portion and a left-hand threaded coupling to the torque lock ring first portion within the polished bore receptacle and the internal left-handed threaded surface of the polished bore receptacle, respectively;

rotating the upper completion assembly relative to the polished bore receptacle;

responsive to rotating the upper completion assembly relative to the polished bore receptacle, engaging the left-hand threaded coupling of the upper completion assembly to the internal left-handed threaded surface of the polished bore receptacle;

responsive to rotating the upper completion assembly relative to the polished bore receptacle, connecting the torque lock ring first portion to the torque lock ring second portion; and engaging the upper completion assembly to the polished bore receptacle.

13. The method of claim 12, wherein engaging the upper completion assembly to the polished bore receptacle comprises forming a sealing surface between the upper completion assembly and the polished bore receptacle.

14. The method of claim 13, further comprising:

determining a condition of the upper completion assembly;

comparing the condition of the upper completion assembly to an expected condition to obtain a comparison result; and based on the comparison result, determining a degree of severity of tubing damage indicating the upper completion assembly requires replacement.

15. The method of claim 14, responsive to determining the degree of severity indicating the upper completion assembly requires replacement, further comprising:

rotating the upper completion assembly requiring replacement relative to the polished bore receptacle;

responsive to rotating the upper completion assembly requiring replacement relative to the polished bore receptacle; disconnecting the upper completion assembly from the polished bore receptacle; and removing the upper completion assembly requiring replacement from the wellbore.

16. The method of claim 15, after removing the upper completion assembly requiring replacement from the wellbore, the method further comprises connecting another upper completion assembly comprising another left-hand threaded coupling to the internal left-handed threaded surface of the polished bore receptacle.

17. The method of claim 12, wherein disposing the lower completion assembly comprising the polished bore receptacle in the wellbore comprises:

positioning the lower completion assembly comprising the polished bore receptacle in the wellbore; and cementing a portion of the lower completion assembly in the wellbore, with a portion of the polished bore receptacle extending from the cement in an uphole direction.

18. A method of completing a wellbore with a completion assembly, the method comprising:

providing a polished bore receptacle having a void extending from a polished bore receptacle-first end to a polished bore receptacle-second end opposite the polished bore receptacle-first end, the polished bore receptacle comprising:

a left-hand threaded surface on an internal surface of the polished bore receptacle; and a right-hand threaded surface on an outer surface of the polished bore receptacle;

placing a joint in the void, the joint comprising:

a joint-first end having a left-hand threaded surface; and a joint-second end having a right-hand threaded surface, the joint-second end opposite the joint-first end;

contacting the left-hand threaded surface of the joint-first end to the left-hand threaded surface on the internal surface of the void;

contacting the joint to the polished bore receptacle by a torque lock ring;

rotating the left-hand threaded surface of the joint-first end relative to the left-hand threaded surface on the internal surface of the void; and responsive to rotating the left-hand threaded surface of the joint-first end relative to the left-hand threaded surface on the internal surface of the void, connecting the joint to the polished bore receptacle by the left-hand threaded surfaces and the torque lock ring, wherein a length of the completion assembly from the joint-second end to the polished bore receptacle-second end is between thirty and fifty feet.

19. The method of claim 18, further comprising:

placing a lower completion string in the wellbore;

connecting the completion assembly to the lower completion string by the polished bore receptacle-second end at a surface of the Earth;

running the completion assembly and the lower completion string into the wellbore;

connecting an upper completion string to the completion assembly by the joint-second end at the surface; and running the upper completion string, the completion assembly, and the lower completion string farther into the wellbore in a downhole direction, the downhole direction from the surface toward a bottom hole location of the wellbore.

20. The method of claim 19, wherein running the upper completion string, the completion assembly, and the lower completion string comprises running the upper completion string, the completion assembly, and the lower completion string through the wellbore with the upper completion string, the completion assembly, and the lower completion string spaced apart from a casing in the wellbore.

* * * * *